United States Patent [19]

Taylor

[11] 4,434,456

[45] Feb. 28, 1984

[54] LUMINAIRE BIRDSHIELD

[75] Inventor: Carl D. Taylor, Hendersonville, N.C.

[73] Assignee: General Electric Company, Schenectady, N.Y.

[21] Appl. No.: 446,809

[22] Filed: Dec. 3, 1982

[51] Int. Cl.[3] ..... F21V 17/00

[52] U.S. Cl. ..... 362/374; 362/362; 362/375; 362/376

[58] Field of Search ..... 362/374, 375, 376, 362

[56] References Cited

U.S. PATENT DOCUMENTS 3,398,291 8/1968 Zerfoss ..... 362/276

4,320,443 3/1982 Zwillich ..... 362/362

*Primary Examiner*—Stephen J. Lechert, Jr.

*Assistant Examiner*—Howard J. Locker

*Attorney, Agent, or Firm*—Ernest W. Legree; Philip L. Schlamp; Fred Jacob

[57] ABSTRACT

A birdshield for closing off the back end of a luminaire having a slipfitter accommodating a range of pipe sizes, is formed from a substantially flat piece of moderately stiff and resilient material cut to a pattern fitting into the rear of the luminaire. A hole through the piece accommodates the smallest size of pipe and a lune-shaped knock-out may be torn out for larger sizes. Bent-out tabs on each side engage the upturned end wall of the slipfitter yoke to hold the birdshield captive.

6 Claims, 3 Drawing Figures

LUMINAIRE BIRDSHIELD

The invention relates to a birdshield for an outdoor luminaire.

BACKGROUND OF THE INVENTION

A small animal shield, commonly known as a birdshield, is usually provided with outdoor luminaires to close off the back. Birds and other small animals including snakes will attempt to enter luminaire housings, perhaps attracted by the warmth or simply seeking shelter or a nesting place. The mode of entry is usually via the opening in the back of the housing where the mounting pipe bracket enters the luminaire. Once inside, the animal will usually touch a live electrical part and be killed but in the process, the unit is often shorted out and a service call is required to replace electrical components or perhaps the entire luminaire. Such a service call usually entails the use of a bucket truck and often requires the detouring of traffic around the work crew and equipment.

The service call necessitated by the lack of a birdshield or the failure of a birdshield to perform its intended function may cost anywhere from a fraction of the cost to an amount in excess of the cost of a replacement luminaire. Birdshields may need to be replaced occasionally because they can be damaged by small animals pecking at them or clawing them to pieces. It is therefore highly desirable to have them easily replaced in the field.

One prior approach to the need for a birdshield has been to make the birdshield an integral part of the luminaire housing which is generally an aluminum casting. Unfortunately, this does not permit a tight fit around the pipe as clearance is required to allow the luminaire housing ±5 degrees of leveling adjustment with respect to the pipe. The integrally cast birdshield also has to be sized for the largest pipe size (2⅜" O.D.) intended to be accommodated in the slipfitter. This means that an excessive gap remains when smaller pipe sizes are used.

Another approach has been to provide a separate birdshield as a loose piece of material, for instance of plastic, fiberboard or metal, having an aperture sized to fit arond the pipe bracket. The birdshield may be simply taped to the inside of the luminaire and the installer is expected to remove it and fit it around the pipe bracket at the time of installation of the luminaire. In practice many installers forget or will not bother to install the birdshield so that the luminaire is left without any barrier to small animals entering through the back of the unit.

A more successful approach to the birdshield problem has been one wherein a separate birdshield is held captive in he luminaire by passing the luminaire mounting bolts through holes in the unit. This eliminates the need to rely on the installer to fit the birdshield around the pipe bracket. But it increases the luminaire assembly labor since the assembler is now required to hold the birdshield in place with its two holes aligned with those in the luminaire housing and must then drive in the slipfitter bolts. Another problem created by this design is that when the birdshield requires replacement, the mounting bolts holding the luminaire to the pipe bracket have to be completely removed in order to install the new birdshield.

SUMMARY OF THE INVENTION

One object of the invention is to provide a birdshield which is firmly captivated in the luminaire housing so that no action of removing from one place and fitting in another is required on the part of the installer when mounting the luminaire on a pipe bracket.

Another object is to provide a birdshield which is easily installed yet easily remoed in the field for replacement by another of identical design.

Other objects and advantages will become apparent from this summary and the detailed description and appended claims following.

In accordance with the invention, the birdshield is a substantially flat piece of moderately stiff and resilient material cut to a shape fitting into the rear end of the luminaire. In the illustrated embodiment a hole is provided for the smallest size pipe accommodated in the slipfitter, and a notched knock-out area can be removed to accommodate larger sizes of pipe. There is also a smaller band-like knock-out area in the upper portion which is torn out when removing a birdshield from around the pipe, of which may be torn out in order to install a replacement with the pipe already in place. A pair of tabs are provided on each side of the piece which are bent back out, the material being resilient enough to restore the tabs to such attitude should they be pressed in. The birdshield is installed by a straight push into place behind the slipfitter, the tabs snapping out and engaging the slipfitter clamp bracket to captivate the birdshield.

DETAILED DESCRIPTION

Figure 2:
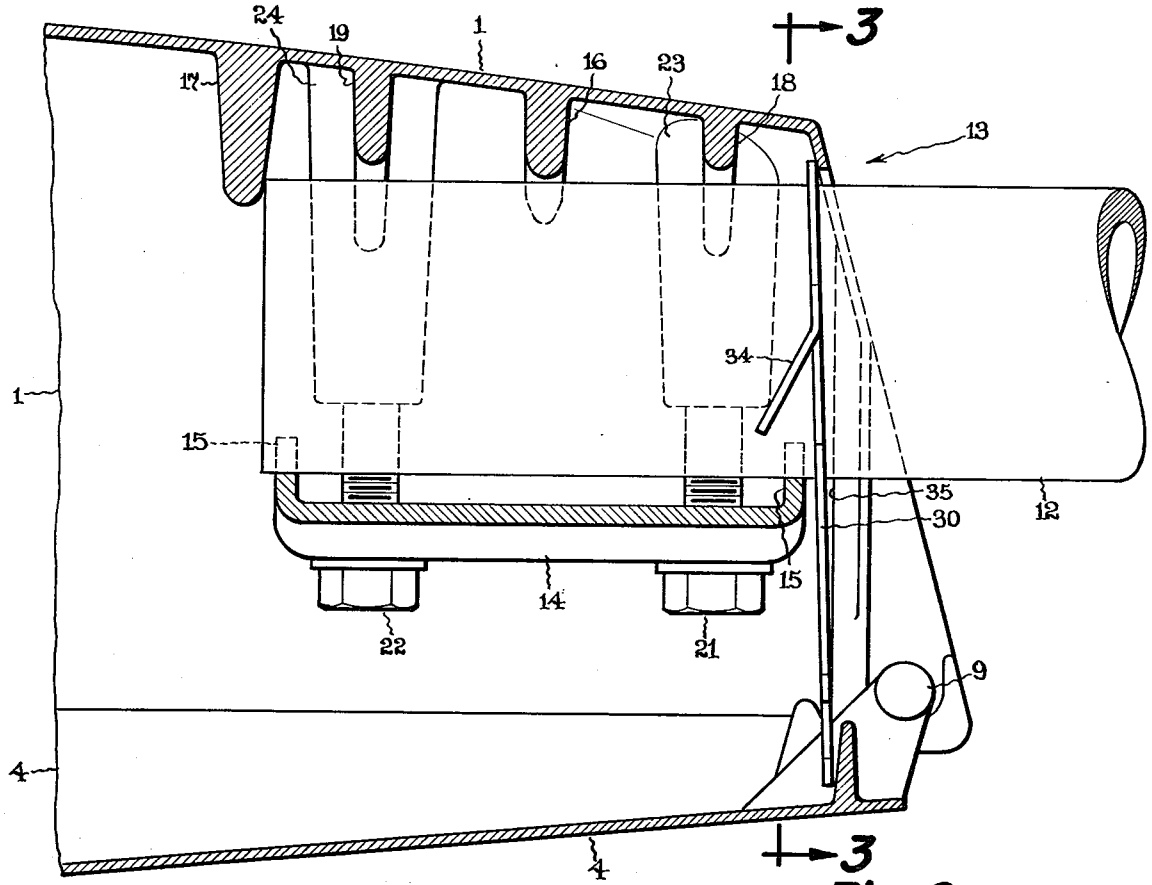
FIG. 2 is a sectional view in side elevation through the rear portion of the luminaire of FIG. 1 in which a birdshield embodying the invention is captivated.
Figure 3:
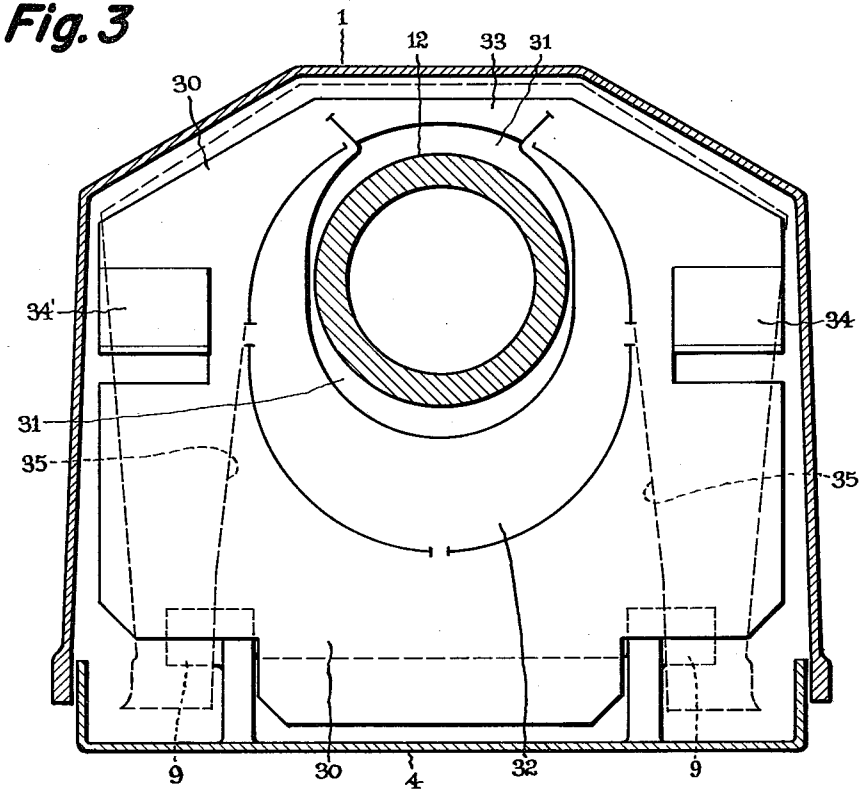
FIG. 3 is a cross-sectional view looking to the rear in the direction of the arrows 3—3.

A birdshield 30 embodying the invention is seen in side view in FIG. 2, and in front elevation looking at the rear side of the luminaire in FIG. 3. In the preferred form illustrated, it is cut from a flat piece of plastic material to the pattern shown in FIG. 3 which fits transversely in the rear of the luminaire. A suitable material is polyethylene 0.062" thick, preferably black to reduce degradation from exposure to sunlight. Other materials such as sheet metal and fiberboard may be used. Metal is less desirable because a knock-out piece could accidentally be left in the luminaire housing by the installer and cause a short.

The birdshield is cut with a hole 31 accommodating a pipe of 1¼" nominal size as is shown in FIG. 3. The hole is somewhat oval e.g. 1.750" wide×2.063" high to allow leveling adjustment. A notched, that is a partially cut out, lune-shaped area 32 is provided, symmetrical about the center-line below the bottom of hole 31. Lune-shaped area 32 may be torn out to make a hole 2.437" wide× 2.812" high which will accommodate nominal pipe sizes up to 2". Although the fit around an intermediate size of pipe such as nominal pipe size 1⅝" (O.D.=2) is not perfect, it is close enough to prevent entry of small animals.

The birdshield is provided with a smaller band-like knock-out area 33 above the top of hole 31. The band knock-out is torn out in the process of removing an originally captive birdshield from around the pipe support in an installed luminaire. To install a replacement birdshield, one tears out band knock-out 33 after which the birdshield can be thrust up into place around the pipe as seen in FIG. 2. Thus the band knock-out permits replacement of the birdshield without removal or dissassembly of any other luminaire parts.

The birdshield is provided with bent-out tabs 34, 34' on each side. Each tab is formed by full cuts though the plastic material along the inside edge and the base, and a partial cut or notch along the top edge which retains the tab to the piece but forces the tab to lean forward relative to the plane of the piece as clearly seen in FIG. 3. The plastic material has enough stiffness and resilience that the tabs revert to the bent-out position should they be momentarily forced in.

The preferred birdshield illustrated is intended to be used with the slip-fitter described and claimed in my copending application Ser. No. 446,807, filed of even date herewith, entitled Luminaire Mounting, and assigned to the same assignee as the present invention, and the disclosure thereof is incorporated herein by reference.

Figure 1:
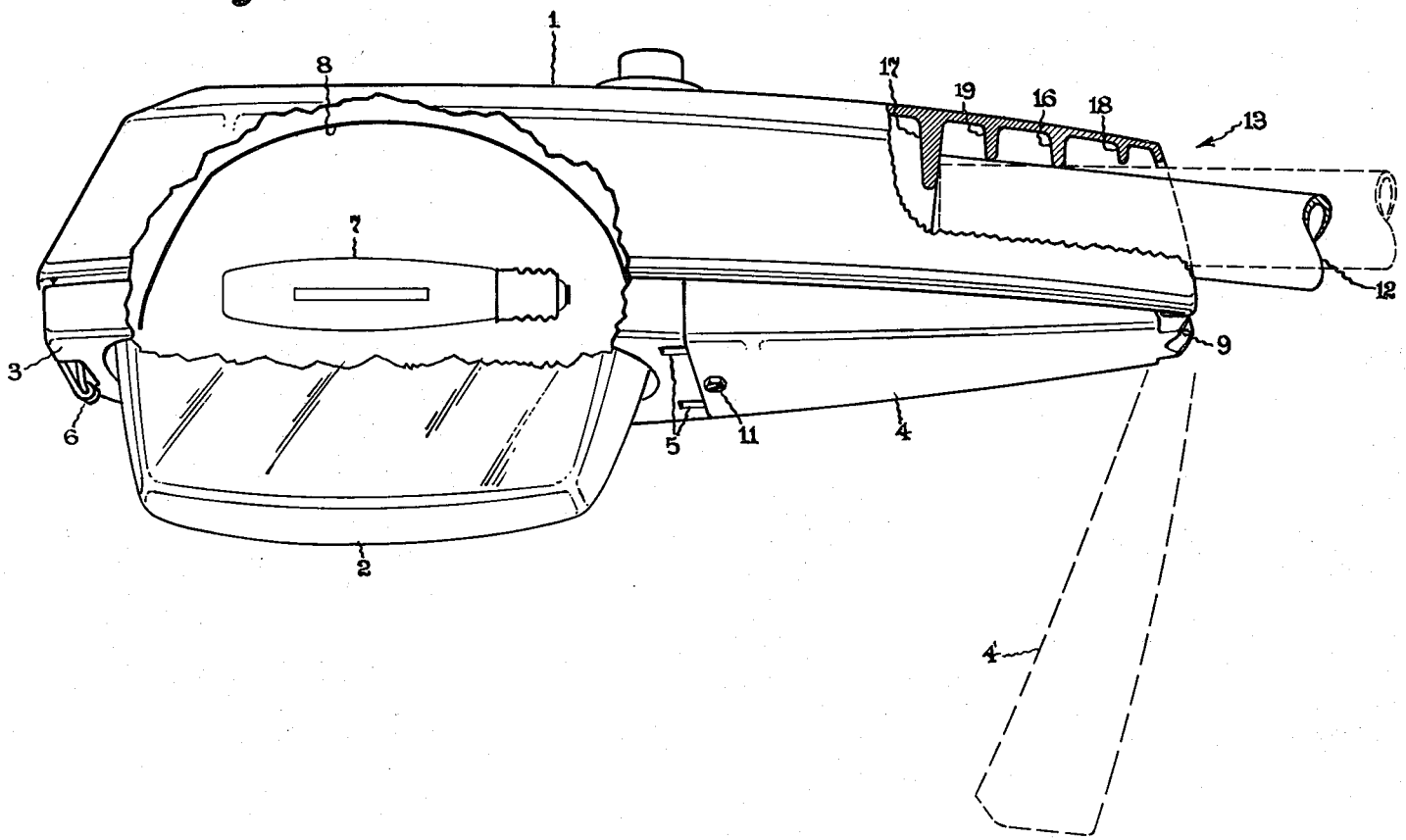
FIG. 1 is a pictorial view, partly broken away, of a typical street lighting luminaire in which the invention may be used.

A suitable street lighting luminaire is illustrated in FIG. 1 and comprises an upper housing 1 whose underside is closed at the front by a refractor 2 supported in a frame member 3, and at the rear by a door 4. The housing may be an aluminum casting of conventional thickness, suitably 0.065" to 0.075". The frame member is hinged at 5 and may be swung down by releasing over-center latch 6 to give access to the high intensity discharge lamp 7 and to the reflector 8 above it. Door 4 is attached by captivating hinge 9 to the rear end of housing 1 (see FIG. 2) so as to be swingable downwardly to the position shown in dash lines in FIG. 1. With door 4 in its open position, access is readily had to the rear interior portion of housing 1, to the ballast components (not shown) for operating the lamp, and at the very back, to the slipfitter parts therein as shown in FIG. 2. The ballast components may be fastened to the inside of the door, an arrangement which facilitates changeouts by replacing the entire door. The front end of door 4 is releasably attached to housing 1 by a screw 11 to retain the door in closed position. The luminaire housing has an opening at its rear end for receiving an elongated support member such as a tubular bracket or pipe 12 extending generally horizontally from a pole or other vertical support. The luminaire is clamped to the support pipe by slipfitter 13 which provides for adjustment of the luminaire about its longitudinal axis and also about a horizontal axis normal thereto through a limited range for leveling purposes.

As shown in FIG. 2, slipfitter 13 comprises yoke means in the form of a single yoke member 14 which is U-shaped in longitudinal section and has end walls 15 which are concave upward. The yoke presses the pipe up against transverse rib 16 in the housing which serves as a pivot. The pipe shown in FIG. 2 corresponds to $1\frac{5}{8}$" nominal size. A leveling adjustment of $\pm 5°$ is provided, auxiliary rib 18 serving as a limit stop to upward tipping and auxiliary rib 19 as the limit stop to downward tipping. Leveling is accomplished by tightening the rear set of bolts 21 until the desired inclination is attained and then tightening the front set 22 to lock in the adjustment.

Birdshield 30 is inserted into the luminaire by pushing it straight in between yoke member 14 and the back wall 35 of the housing. As the tabs 34 ride over the upturned rear end wall 15 of the yoke, they fold in then "snap" out and the birdshield is locked in. The interaction of the tabs and the end wall of the slipfitter yoke which serves as hook means not only holds the birdshield in place during assembly, but also keeps it captive during shipment, handling and installation. There is enough "give" to the tabs that they will accommodate by bending more with a smaller support pipe and less with a larger pipe. When removing a birdshield, a good tug will make the tabs fold back double and release the birdshield.

While the invention has been described with reference to a particular embodiment thereof, it will be understood that various modifications may be made by those skilled in the art without departing from the invention. To mention but the most obvious, hook means other than yoke member 14 of the slipfitter may be provided which tabs 34, 34' of the birdshield may engage for captivation of the birdshield. The appended claims are intended to cover all such equivalent variations coming within the true spirit and scope of the invention.

What I claim as new and desire to secure by Letters Patent of the United States is:

1. A luminaire comprising a housing having slipfitter accommodating a range of pipe sizes as support entering through the back and a birdshield closing off the back end, said birdshield comprising a substantially flat piece of moderately stiff and resilient material cut to a pattern fitting into the rear of the luminaire housing and having a hole therethrough proportioned to receive a size of pipe accommodated in said slipfitter, and means holding said birdshield captive in said luminaire comprising bent-out tabs on each side of said piece retained to the piece along their top edge and leaning forward relative to the plane of the piece, said tabs being disposed to fold in under hook means in said housing and then snap out and engage the hook means when the birdshield is inserted up into the luminaire.

2. A luminaire as in claim 1 wherein said slipfitter comprises a yoke member having an upturned end wall serving as hook means which said tabs engage to hold the birdshield captive.

3. A luminaire as in claim 1 wherein said flat piece includes a knock-out area which may be torn out to enlarge said hole for receiving a larger size of pipe.

4. A birdshield for closing off the back end of a luminaire having a housing with a slipfitter accommodating a range of pipe sizes as supports comprising;

a substantially flat piece of moderately stiff and resilient material cut to a pattern fitting into the rear end of the luminaire housing for which intended, a hold through said piece proportioned to receive the smallest size of pipe accommodated in said slipfitter, a lune-shaped knock-out area about said hole which may be torn out to enlarge the hole for receiving larger sizes of pipe accommodated in said luminaire, and means for holding said birdshield captive in the rear end of the luminaire comprising bent-out tabs on each side of said piece retained to the piece along their top edge and leaning forward relative to the plane of the piece, said tabs being disposed to engage hook or bracket means in the luminaire upon insertion into it.

5. A birdshield as in claim 4 wherein said piece includes a band-like knock-out area above said hole which may be torn out to remove or replace the birdshield with the pipe support in place.

6. The combination of a birdshield as in claim 4 and a luminaire having a slipfitter comprising a yoke member having an upturned end wall, said tabs engaging said end wall to hold the birdshield captive.

* * * * *